US007604395B2

(12) United States Patent
Cabezas Jurin et al.

(10) Patent No.: US 7,604,395 B2
(45) Date of Patent: Oct. 20, 2009

(54) ANCHOR ESCAPEMENT INCLUDING TWO ESCAPE WHEEL SETS

(75) Inventors: Andrés Cabezas Jurin, Yverdon-les-Bains (CH); Thierry Conus, Lengnau (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 12/105,558

(22) Filed: Apr. 18, 2008

(65) Prior Publication Data

US 2008/0304369 A1 Dec. 11, 2008

(30) Foreign Application Priority Data

Apr. 18, 2007 (EP) ..... 07106378

(51) Int. Cl.
*G04B 15/00* (2006.01)

(52) U.S. Cl. ..... 368/127; 368/124; 368/131

(58) Field of Classification Search ..... 368/124, 368/125, 127, 128, 129, 130, 131
See application file for complete search history.

(56) References Cited

U.S. PATENT DOCUMENTS

| | | | | |
|---|---|---|---|---|
| 0,594,446 | A | 11/1897 | Voigt | |
| 1,037,342 | A | 9/1912 | Shortill | |
| 1,091,261 | A | 3/1914 | Walker | |
| 2,531,273 | A | 11/1950 | Jaccard | |
| 6,301,981 | B1 | 10/2001 | Oechslin | |
| 6,708,576 | B2 | 3/2004 | Oechslin | |
| 6,802,645 | B2 | 10/2004 | Ludwig | |
| 7,097,350 | B1 * | 8/2006 | Conus et al. | 368/127 |
| 7,192,180 | B2 | 3/2007 | Hayek et al. | |
| 7,366,058 | B2 | 4/2008 | Marki et al. | |
| 2005/0128880 | A1 | 6/2005 | Hayek et al. | |
| 2006/0221774 | A1 | 10/2006 | Conus et al. | |

FOREIGN PATENT DOCUMENTS

| | | |
|---|---|---|
| CH | 4698 | 3/1892 |
| CH | 373703 | 1/1964 |
| EP | 0 018 796 | 11/1980 |
| EP | 1 045 297 | 10/2000 |
| EP | 1 367 462 A1 | 12/2003 |

(Continued)

OTHER PUBLICATIONS

European Search Report issued in corresponding application No. EP 07 10 6378 completed Feb. 21, 2008.

(Continued)

*Primary Examiner*—Truc T Nguyen
*Assistant Examiner*—Jason Collins
(74) *Attorney, Agent, or Firm*—Griffin & Szipl, P.C.

(57) ABSTRACT

The escapement includes two distinct escape wheel sets (1, 2), a roller (3) including a first impulse pallet stone (5) cooperating with the first wheel set (1) and a third impulse pallet stone (12) cooperating with the second wheel set (2). An anchor piece (6) articulated on a pivot (7) cooperates with an impulse pin (4) via a fork (8) fitted to the anchor piece. This anchor piece carries second (9) and fourth (13) impulse pallet stones respectively cooperating with the first (1) and second (2) wheel sets. The same anchor piece carries first (10) and second (11) locking pallet stones cooperating with the second wheel set (2).

7 Claims, 4 Drawing Sheets

FOREIGN PATENT DOCUMENTS

EP 1 708 047 10/2006

OTHER PUBLICATIONS

Daniels, George, "La Montre: Principes et Methodes de Fabrication," 1993, pp. 247-248.
Chamberlain, P. M., "It's About Time—The Lever Escapement," 1978, pp. 77-81.
Daniels, George, "La Montre: Principes et Methodes de Fabrication," 1993, pp. 236-248.
Office Action issued in related U.S. Appl. No. 12/105,492, mailed Sep. 17, 2008.
Notice of Allowance issued in co-pending related U.S. Appl. No. 12/105,644, dated Jun. 15, 2009.
Office Action issued in co-pending related U.S. Appl. No. 12/105,447, dated Jun. 22, 2009.

* cited by examiner

ANCHOR ESCAPEMENT INCLUDING TWO ESCAPE WHEEL SETS

This application claims priority from European Patent Application No. 07106378.8, filed Apr. 18, 2007, the entire disclosure of which is incorporated herein by reference.

FIELD OF THE INVENTION

The invention relates to an anchor escapement for a timepiece, including a first escape wheel set, driven by a first gear train, a balance roller carrying an impulse pin and first pallet stone arranged for cooperating with the teeth of the first impulse wheel set and a anchor piece articulated on a pivot and fitted with a fork cooperating with the impulse pin, a second impulse pallet stone arranged for cooperating with the teeth of the first wheel set, and first and second locking pallet stones arranged for cooperating with the teeth of the first wheel set.

BACKGROUND OF THE INVENTION

An anchor escapement answering the description that has just been was disclosed in the work entitled "La Montre: principes et méthodes de fabrication", by George Daniels, Scriptar Editions S.A., La Conversion, Lausanne 1993. This escapement is explained at pages 247 and 248 of said work, under the title "Echappement Daniels à roue simple". According to the author, it was constructed by way of experiment to be used in a wristwatch. As a variant and as will be seen in the description below, the escape wheel set may include two coaxial wheels secured to each other, which leads to a coaxial double wheel escapement described in the same work at pages 240 to 246. Whichever variant is chosen, it will be clear that these constructions include only one escape wheel set implementing one or two coaxially mounted wheels.

SUMMARY OF THE INVENTION

In addition to complying with the statement of the first paragraph above, the present invention is characterized in that the escapement includes a second escape wheel set driven by a second gear train, in that the roller carries a third impulse pallet stone arranged for cooperating with the teeth of the second wheel set and in that the anchor piece is fitted with a fourth impulse pallet stone arranged for cooperating with the teeth of the second wheel set and third and fourth pallet stones faces arranged for cooperating with the teeth of said wheel set.

It will be clear that an escapement fitted with two distinct escape wheel sets allows a dual display each displaying showing an indication of different time zones.

BRIEF DESCRIPTION OF THE DRAWINGS

The invention will now be explained in detail below via two embodiments, given by way of non-limiting example, these embodiments being illustrated by the drawings, in which.

DETAILED DESCRIPTION OF THE ILLUSTRATIVE EMBODIMENTS

Figure 1:
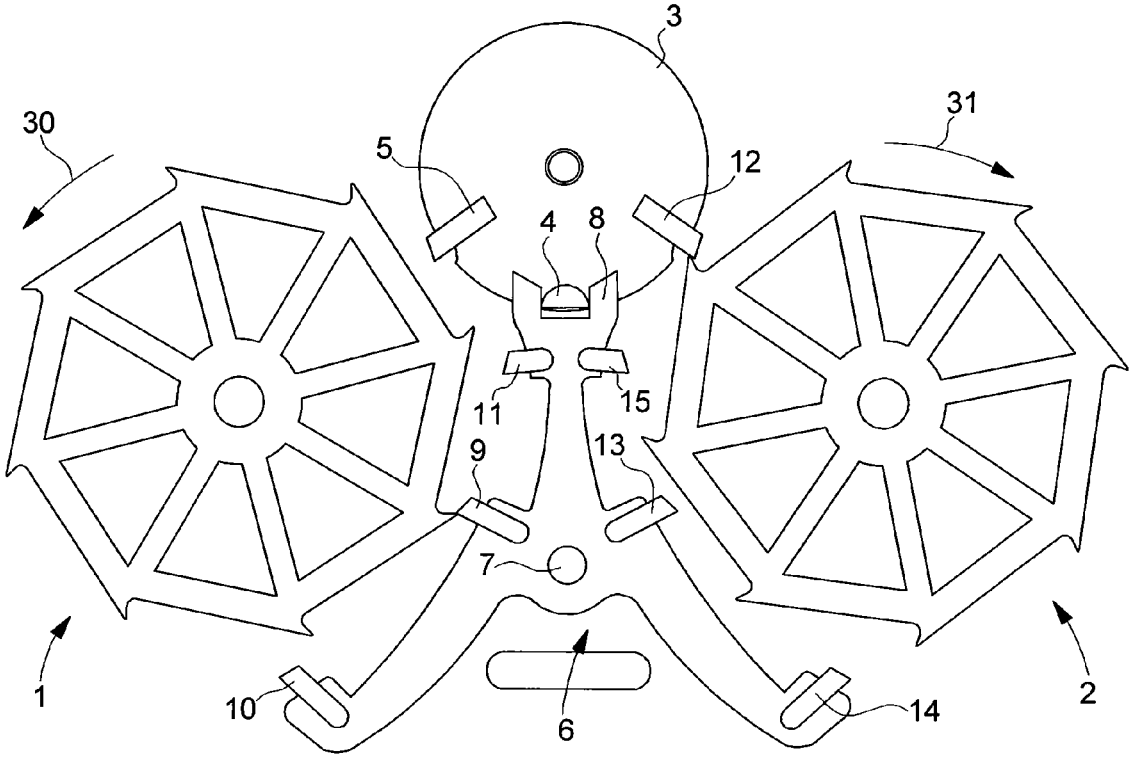
FIG. 1 is a plan view of a first embodiment of the invention wherein each escape wheel set has only one wheel.

FIG. 1 is a plan view of the escapement mechanism according to a first embodiment of the present invention. This escapement includes a first escape wheel set 1 fitted with a single escape wheel driven by a first gear train that is not shown. When wheel set 1 is free, it rotates in the anticlockwise direction as indicated by arrow 30. The escapement also includes a roller 3 that is not shown. The roller 3 carries an impulse pin 4 and a first impulse pallet stone 5, this pallet stone being arranged for cooperating with the teeth of first wheel set 1. The escapement also includes an anchor piece 6 articulated on a pivot 7. The anchor piece is fitted with a fork 8 cooperating with the impulse pin 4 of roller 3. The anchor piece also carries a second impulse pallet stone 9 arranged for cooperating with first and second locking pallet stones 10 and 11 also arranged for cooperating with said first wheel set 1.

As is shown clearly in FIG. 1, the present invention is characterized in that the escapement includes a second escape wheel set 2 driven by a second gear train that is not shown. When wheel set 2 is free it rotates in the clockwise direction indicated by arrow 31. In this first embodiment, wheel set 2 has only one wheel and roller 3 carries a third impulse pallet stone 12 arranged for cooperating with the teeth of the second wheel set 2. FIG. 1 also shows that anchor piece 6 is fitted with a fourth impulse pallet stone 13 arranged for cooperating with the teeth of second wheel set 2, this anchor piece also being fitted with third and fourth locking faces 14 and 15 arranged for cooperating with the teeth of said second wheel set 2.

Figure 2:
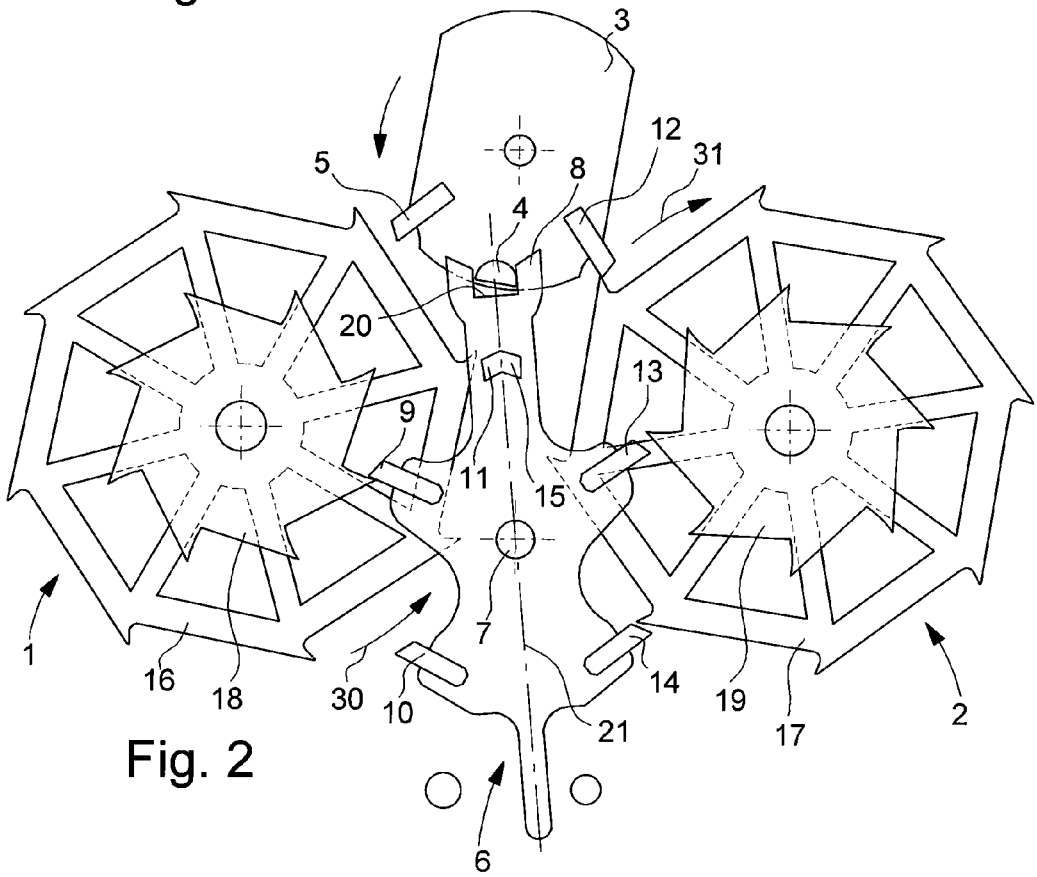
FIG. 2 is a plan view of a second embodiment of the invention wherein each escape wheel set includes two coaxial wheel sets secured to each other.

FIG. 2 is a plan view of a second embodiment of the invention. Here, the first escape wheel set 1 is not a single wheel, but includes first and second wheels 16 and 18 secured to each other and mounted coaxially on each other. The same is true of the second escape wheel set 2, which is formed of first and second coaxial wheels 17 and 19 secured to each other. FIG. 2 shows that the escapement includes a roller 3 fitted with the same impulse pallet stones 5 and 12 as those fitted to roller 3 of the first embodiment. FIG. 2 shows again an anchor piece fitted with a fork 8 cooperating with impulse pin 4 fitted to roller 3. Anchor piece 6 is fitted with the same impulse pallet stones 9 and 13 and the same locking pallet stones 10, 14 and 11, 15 as those fitted to anchor piece 6 of the first embodiment. More specifically, the first impulse pallet stone 5 and the first and second locking faces 10 and 11 cooperate with the first wheel 16 of the first wheel set 1, whereas the second impulse pallet stone 9 cooperates with the second wheel 18 of the first wheel set 1. Likewise, the third impulse pallet stone 12 and the third and fourth locking pallet stones 14 and 15 cooperate with the first wheel 17 of the second wheel set 2, whereas the fourth impulse pallet stone 13 cooperates with the second wheel 19 of the second wheel set 2.

FIG. 2 also shows that the first wheel 16 of the first wheel set 1 has a larger diameter than the diameter of the second wheel 18 of said wheel set 1. The same is true of the second wheel set 2 wherein the first wheel 17 is larger than the second wheel 19. This construction allows the dimensions of the escapement mechanism to be reduced. In fact, if we compare FIGS. 1 and 2, we can see that the distance separating the arbours of wheel sets 1 and 2 of FIG. 2 is shorter than the distance separating the same arbours shown in FIG. 1. Wheel sets 1 and 2 have moved closer to anchor piece 6 as shown in FIG. 2.

It will also be noted that in the escapement of the present invention, anchor piece 6 has an axis of symmetry 21 drawn in FIG. 2. This axis of symmetry 21 passes through pivot 7 of the anchor piece and through the centre of the recessed space 20 of fork 8. FIG. 2 shows clearly that the second and fourth impulse pallet stones 9 and 13 are also moved away from axis of symmetry 21. The same is true of the second and fourth locking pallet stones 11 and 15, and the first and second locking pallet stones 10 and 14.

It will also be seen in FIG. 2 that the second and fourth locking faces 11 and 15 are sufficiently close to each other to be made in a single piece.

The operation of the escapement according to the invention will now be explained. In order to do so, we will use the second embodiment comprising two escape wheels for each of wheel sets 1 and 2. One complete oscillation of roller 3 is illustrated in FIGS. 3 to 14. The various operating phases will be analysed below.

Figure 3:
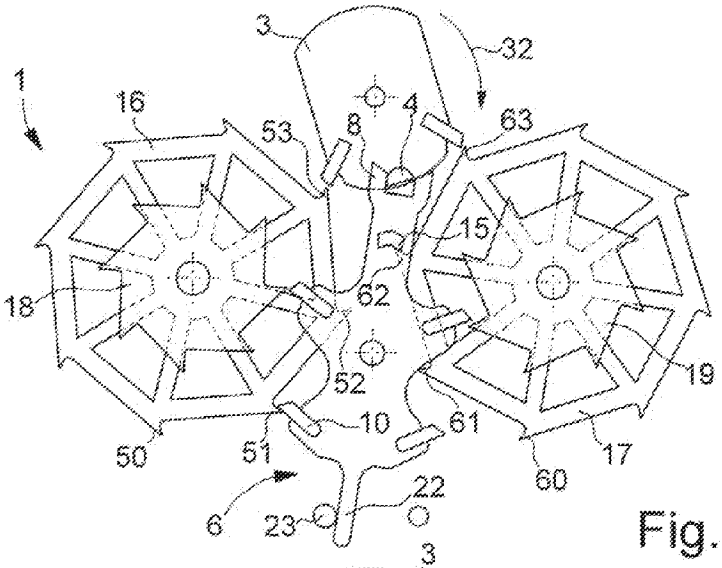

In FIG. 3, roller 3 is rotating in the direction of arrow 32. The wheel set 1 is locked on first pallet stone 10 via tooth 51 of its first wheel 16. Wheel set 2 is also locked on pallet stone 15 via tooth 62 of its first wheel 17. Impulse pin 4 of roller 3 enters into contact with fork 8. Anchor piece 6 is locked and the tail 23 thereof is abutting on a banking pin 23. This is the start of unlocking.

Figure 4:
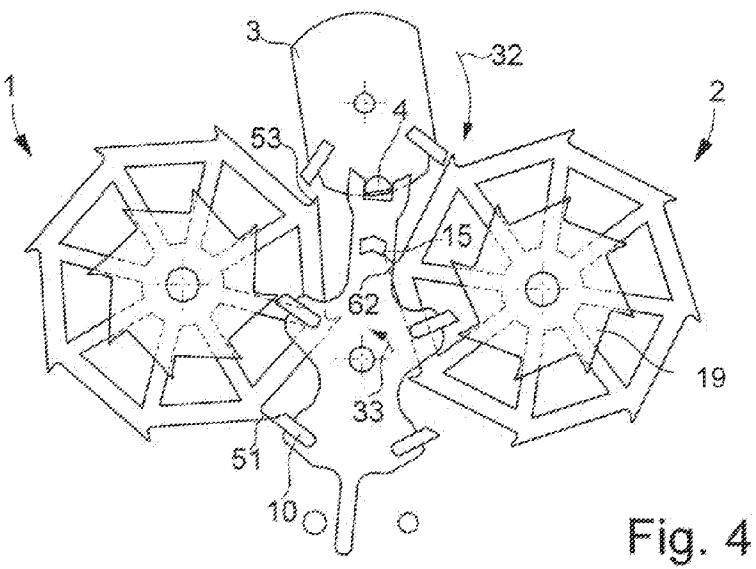
FIGS. 3 to 14 are plan views explaining the operating phases of the escapement in accordance with the second embodiment of the invention, these phases covering one complete oscillation of the balance roller.

In FIG. 4, roller 3 has continued its travel in the direction of arrow 32. Impulse pin 4 of roller 3 drives anchor piece 6 in the direction of arrow 33, releasing tooth 51 and tooth 62 from the respective hold of pallet stones 10 and 15. Wheel sets 1 and 2 are thus released.

Figure 5:
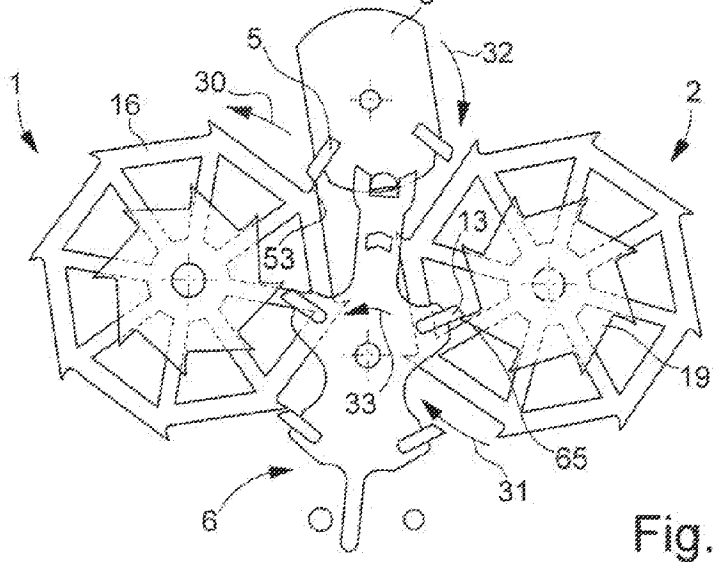

As FIG. 5 shows, the wheel set 1 rotates in the direction of arrow 30 and wheel set 2 in the direction of arrow 31. Tooth 53 of the first wheel 16 of wheel set 1 enters into contact with pallet stone 5 of roller 3 and imparts an impulse to said roller, which continues its travel in the direction of arrow 32. Simultaneously, tooth 65 of the second wheel 19 of the second wheel set 2 enters into contact with pallet stone 13 of anchor piece 6 and imparts a simultaneous impulse to said roller. This is the start of the impulse phase.

Figure 6:
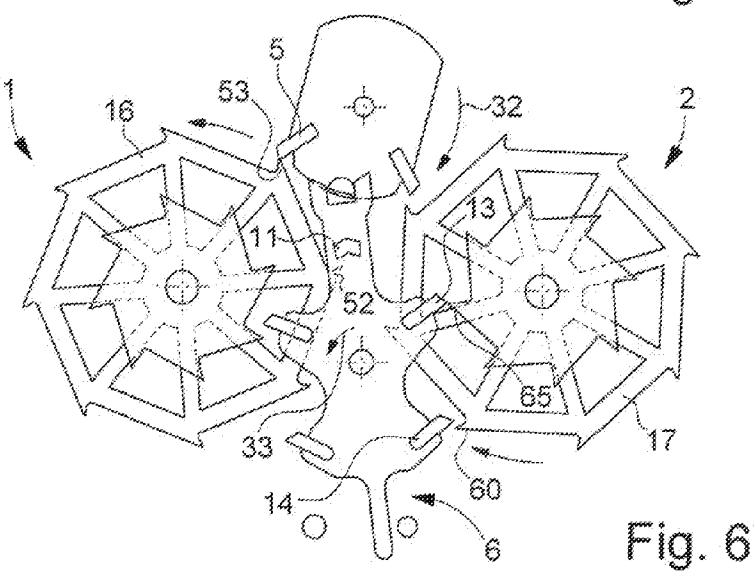

The end of impulse phase is shown in FIG. 6. Teeth 53 and 65 leave the impulse pallet stones 5 and 13 respectively, while anchor piece 6, continuing its travel in the direction of arrow 33, causes locking pallet stone 11 to intersect the trajectory of tooth 52 of the first wheel 16 of wheel set 1, and locking pallet stone 14 to intersect the trajectory of tooth 60 of the first wheel 17 of wheel set 2.

Figure 7:
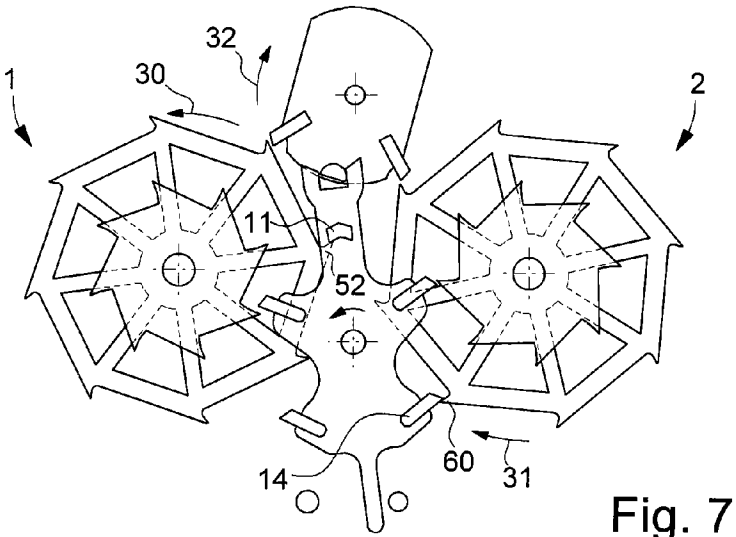

In FIG. 7, wheel sets 1 and 2 have continued their travel along arrows 30 and 31 respectively. Tooth 52 of first wheel set 1 and tooth 60 of second wheel set 2 have a butted onto locking faces 11 and 14 respectively and simultaneously. It is the lock that stops the two wheel sets. The roller continues its travel along arrow 32

Figure 8:
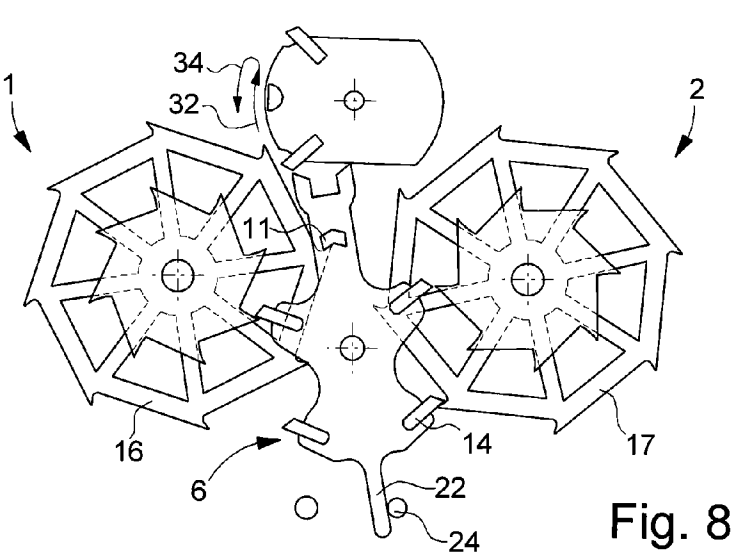

FIG. 8 shows the total lock of the two escape wheel sets 1 and 2. Via the draw effect caused by the torque exerted by these wheel sets, pallet stones 11 and 14 are pushed further inside the toothings of the first and second wheels 16 and 17. Roller 3 describes its supplementary arc in the direction of arrow 32 then retraces its steps as indicated by arrow 34. The tail 22 of anchor piece 6 is abutting on a banking pin 24.

Figure 9:
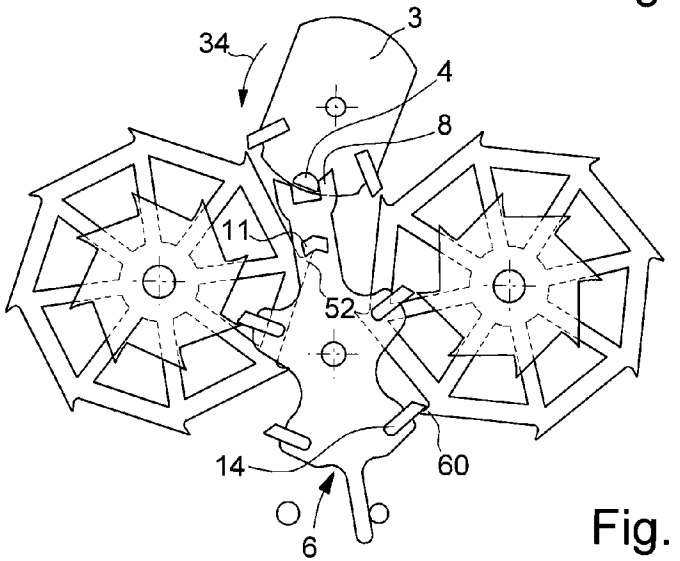

In FIG. 9 roller 3, rotating in the direction of arrow 34 brings its impulse pin 4 into contact with fork 8 of anchor piece 6. This is the start of a phase of unlocking of teeth 52 and 60 from the hold of locking pallet stones 11 and 14 reciprocally.

Figure 10:
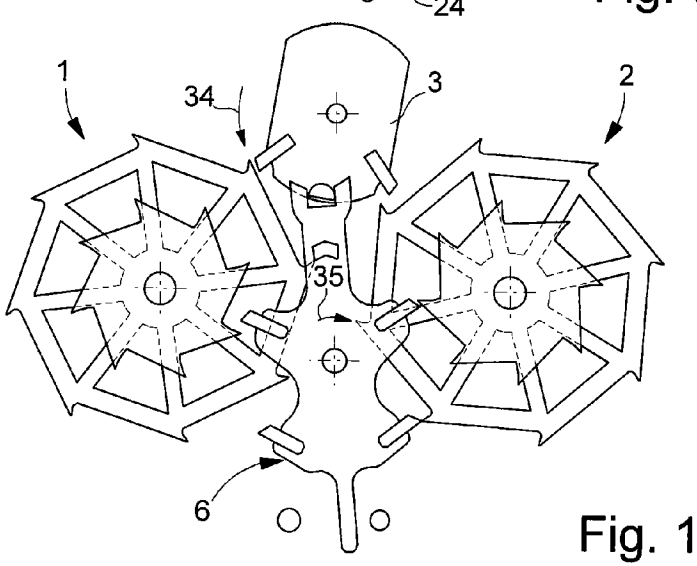

FIG. 10 illustrates the end of unlocking. In fact, roller 3, continuing its travel in the direction of arrow 34, rotates anchor piece 6 in the direction of arrow 35 causing the total simultaneous unlocking of escape wheel sets 1 and 2 which are released.

Figure 11:
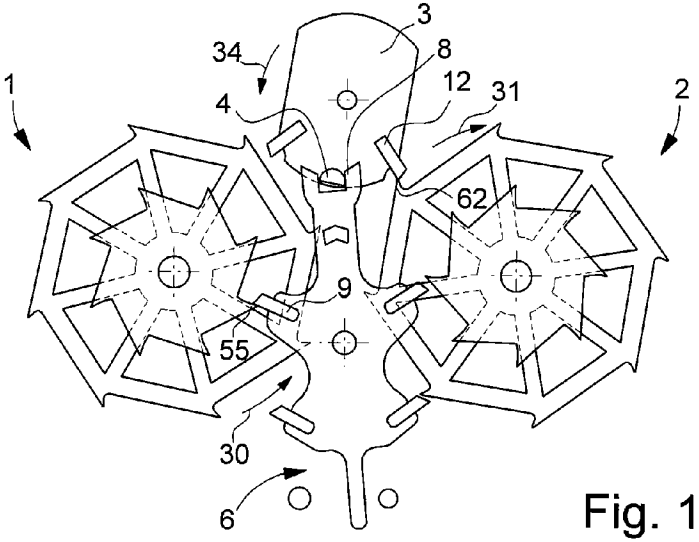

The start of a new impulse is shown in FIG. 11. The first wheel set 1 rotates in the direction of arrow 30 and drives tooth 55, which enters into contact with impulse pallet stone 9 of anchor piece 6. At the same time, the second wheel set 2 rotates in the direction of arrow 31 and drives tooth 62, which enters into contact with impulse pallet stone 12 of roller 3. Roller 3 is thus relaunched in the direction of arrow 34.

Figure 12:
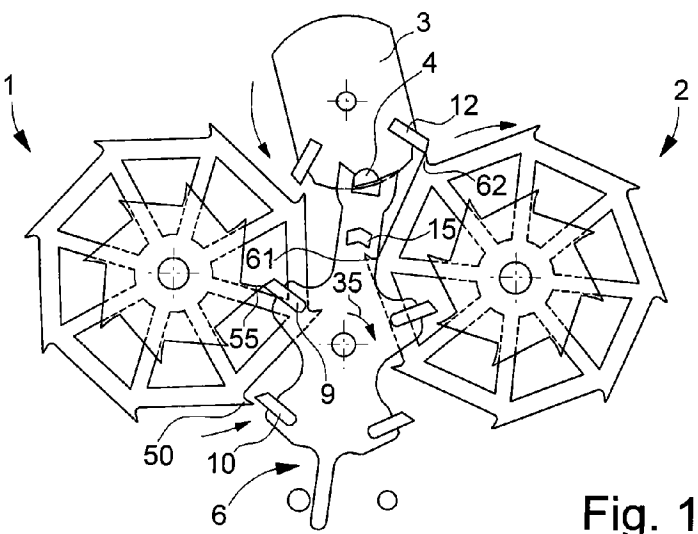

FIG. 12 shows the end of the impulse. Tooth 62 of the second wheel set 2 leaves pallet stone 12 of roller 3 and tooth 55 of the first wheel set 1 leaves pallet stone 9 of anchor piece 6. The latter has rotated in the direction of arrow 35 driven by impulse pin 4 of roller 3. This rotation has brought locking pallet stones 10 and 15 into the trajectory of teeth 50 (wheel set 1) and 61 (wheel set 2) respectively.

Figure 13:
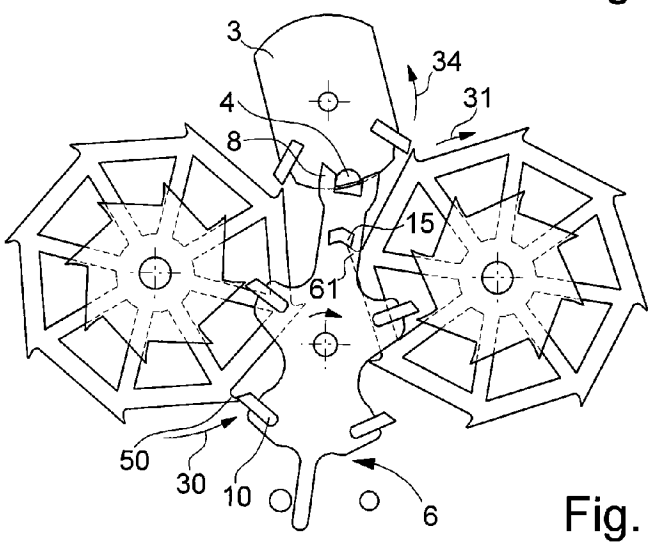

FIG. 13 shows a new lock. While rotating in the direction of arrow 30, tooth 50 of wheel set 1 has been intercepted by locking pallet stone 10 of anchor piece 6. Likewise, while rotating in the direction of arrow 31, tooth 61 of wheel set 2 has been stopped by locking pallet stone 15 of anchor piece 6. By continuing to rotate in the direction of arrow 34, impulse pin 4 of roller 3 is released from fork 8.

Figure 14:
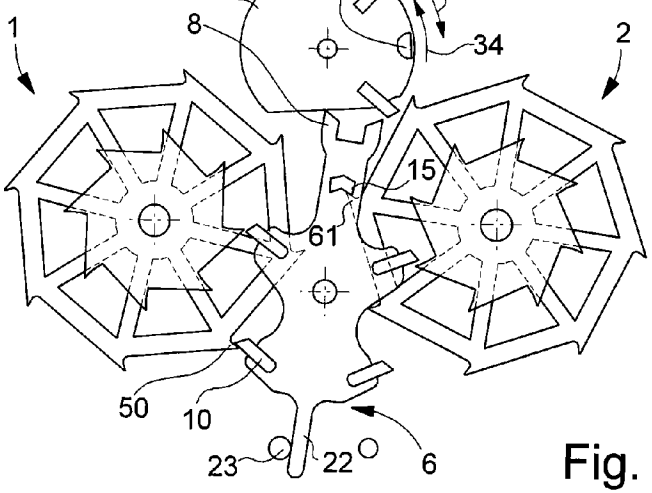

FIG. 14 shows the total lock of wheel sets 1 and 2. By rotating in the direction of arrow 34, impulse pin 4 of roller 3 completely exits from fork 8. The draw effect exerted by wheel sets 1 and 2 has caused locking pallet stones 10 and 15 to penetrate more deeply along teeth 50 and 61 respectively. Tail 22 of anchor piece 6 is abutting against banking pin 23. From this moment, the roller 3 and the balance associated therewith describe their supplementary arc in the direction of arrow 34, and then retrace their steps along the direction of arrow 32. One complete oscillation of roller 3 has thus been achieved and described in detail. We are then once again in the situation shown in FIG. 3 and a new cycle or oscillation can start as soon as impulse pin 4 of roller 3 penetrates fork 8 again.

During the oscillation examined above, two impulses were imparted to roller 3 and to the sprung balance associated therewith. The first impulse occurs during the first oscillation when roller 3 is rotating in the direction of arrow 32. This first impulse is double since it comes simultaneously from wheel sets 1 and 2 (FIGS. 5 and 6). The second impulse occurs during the second oscillation when roller 3 is rotating in the direction of arrow 34. This second impulse is also double since it comes simultaneously from wheel sets 1 and 2 (FIGS. 11 and 12).

The invention claimed is:

1. An anchor escapement for a timepiece, including:

a first escape wheel set driven by a first gear train;

a balance roller carrying an impulse pin and a first impulse pallet stone arranged for cooperating with teeth of the first escape wheel set, and, an anchor piece articulated on a pivot and provided with a fork cooperating with the impulse pin of the balance;

a second impulse pallet stone arranged for cooperating with the teeth of the first escape wheel set and with first and second locking pallet stones arranged to cooperate with the teeth of the first escape wheel set;

a second escape wheel set driven by a second gear train, wherein the balance roller carries a third impulse pallet stone arranged for cooperating with teeth of the second escape wheel set, and, wherein the anchor piece is fitted with a fourth impulse pallet stone arranged for cooperating with the teeth of the second escape wheel set, and third and fourth locking pallet stones arranged for cooperating with the teeth of said second wheel set.

2. The escapement according to claim 1, wherein each of the first and second wheel sets is formed of first and second coaxial wheels secured to each other, wherein the first impulse pallet stone and the first and second locking pallet stones cooperate with the first wheel of the first wheel set, wherein the second impulse pallet stone cooperates with the second wheel of said first wheel set, wherein the third impulse pallet stone and the third and fourth locking pallet stones cooperate with the first wheel of the second wheel set and wherein the fourth impulse pallet stone cooperates with the second wheel of said second wheel set.

3. The escapement according to claim 2, wherein the first wheels of the first and second wheel sets have a larger diameter than the diameter of the second wheels of said first and second wheel sets.

4. The escapement according to claim 1, wherein the anchor piece has an axis of symmetry that passes through a pivot and a center of a recessed space of the fork, wherein the second and fourth impulse pallet stones, the second and fourth locking pallet stones and the first and third locking pallet stones are removed from the axis of symmetry.

5. The escapement according to claim 2, wherein the anchor piece has an axis of symmetry that passes through a pivot and a center of a recessed space of the fork, wherein the second and fourth impulse pallet stones, the second and fourth locking pallet stones and the first and third locking pallet stones are removed from the axis of symmetry.

6. The escapement according to claim 1, wherein the second and fourth locking pallet stones are made in a single piece.

7. The escapement according to claim 2, wherein the second and fourth locking pallet stones are made in a single piece.

* * * * *